US012371986B1

(12) United States Patent
Dyngosz et al.

(10) Patent No.: US 12,371,986 B1
(45) Date of Patent: Jul. 29, 2025

(54) MONITORING A DRILLING OPERATION USING ARTIFICIAL INTELLIGENCE

(71) Applicant: Halliburton Energy Services, Inc., Houston, TX (US)

(72) Inventors: Mateusz Michal Dyngosz, Houston, TX (US); Dale E. Jamison, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/812,606

(22) Filed: Aug. 22, 2024

(51) Int. Cl.
*E21B 44/00* (2006.01)
*E21B 45/00* (2006.01)

(52) U.S. Cl.
CPC ..... *E21B 44/00* (2013.01); *E21B 45/00* (2013.01); *E21B 2200/22* (2020.05)

(58) Field of Classification Search
CPC ..... E21B 2200/22; E21B 45/00; E21B 44/00
See application file for complete search history.

(56) References Cited

U.S. PATENT DOCUMENTS

| | | | | |
|---|---|---|---|---|
| 7,103,460 | B1 | 9/2006 | Breed | |
| 2016/0201449 | A1* | 7/2016 | Dirksen | E21B 7/10 702/9 |
| 2019/0345810 | A1* | 11/2019 | Ocegueda-Hernandez | G05B 13/042 |
| 2021/0115779 | A1* | 4/2021 | Hopwood | E21B 21/08 |
| 2021/0222539 | A1* | 7/2021 | Kroczka | E21B 47/12 |
| 2022/0056799 | A1* | 2/2022 | Johnson | E21B 44/00 |
| 2024/0070403 | A1* | 2/2024 | Meng | G06F 40/51 |

FOREIGN PATENT DOCUMENTS

| | | | |
|---|---|---|---|
| CA | 3072045 | A1 | 2/2019 |
| CA | 3177620 | A1 | 11/2022 |

* cited by examiner

*Primary Examiner* — Tara Schimpf
*Assistant Examiner* — Lamia Quaim
(74) *Attorney, Agent, or Firm* — Conley Rose, P.C.; Rodney B. Carroll

(57) ABSTRACT

A method of monitoring a drilling operation of a drilling rig includes receiving one or more parameters of a drilling operation of a drilling rig. The one or more parameters are detected by one or more sensors. The method further includes recognizing, using a trained machine-learning model, a signature in the one or more parameters; determining a corrective action based on the recognized signature; and outputting a recommendation for performing the corrective action or autonomously executing the corrective action.

20 Claims, 6 Drawing Sheets

MONITORING A DRILLING OPERATION USING ARTIFICIAL INTELLIGENCE

BACKGROUND

In oil and gas wells, the primary purpose of drilling the wellbore is the extraction of hydrocarbons from a hydrocarbon bearing formation. Oil and gas wells may be drilled through a variety of subterranean formations. Typically, an oil well is drilled to a desired depth with a drill bit and mud fluid system. Wellbore drilling includes rotating a drill bit while controlling the application of axial force to the drill bit. The rotation and applied axial force are typically controlled by equipment at the surface generally referred to as a drilling rig. The drilling rig includes various equipment to lift, rotate, and control segments of drill string coupled to the drill bit. The mud fluid system is pumped down the drill string to cool the drill bit and transport drill cuttings to surface.

The speed at which the drill bit penetrates the subterranean formation depends on the mechanical properties of the subterranean formation, the size and type of the drill bit, the rotary speed and the axial force applied to the drill bit. In other words, rate of penetration of the drill bit depends on the rotary speed and axial force applied to a drill bit for a given subterranean formation. Also, the rate at which a drill bit dulls or wears out depends on the rotary speed and axial force applied to the drill bit. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
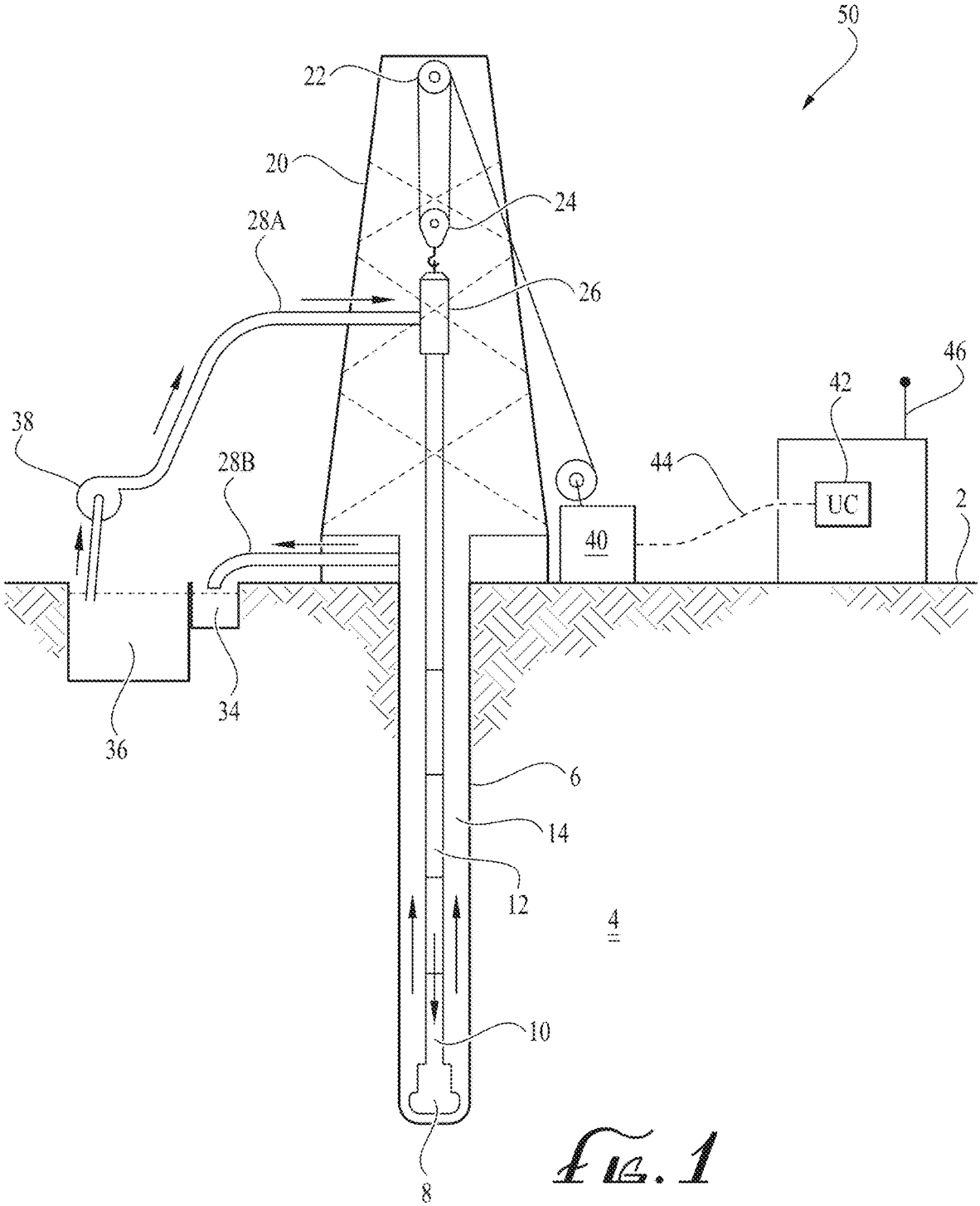
FIG. 1 is a schematic diagram of a well system, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

In a drilling operation, the work load put on the top drive may be significantly different depending on what operation is in progress (e.g., drilling, circulating, etc.). The signatures for these operations can potentially be visible and show significant changes when transitioning between different formations. The different formations may have different properties such as hardness, toughness, abrasiveness, density, and/or thermal properties. Those parameters may together impact how much work (e.g., power) is needed to be put into drilling. Some or all of this information along with seismic images, drilling parameters, fluid properties, etc., may be sent to neural network or other artificial intelligence (AI) embodiment to process the data, derive the possible outcomes, and/or provide a categorization of the events. In some embodiments, wattage, voltage, amperage, etc. are measured and used for detection of a signature. The neural network may be configured to process the data. Related software could be embedded into the device on the rig and/or integrated with existing software that collects and processes data. The system could be implemented on an AI neural engine, a tensor processing unit (TPU), a neural tensor unit (NTU), a logical tensor unit (LTU), or any other suitable engine.

In some embodiments, a connector or data transfer into the system is implemented that can decode the data. This may include, for example, using Wits-ML or any other suitable protocol. Data processing and data changes required to decode the information from the power usage signatures from the top drive may be performed by a neural network and/or another AI application. This could be performed by AI processing using such as NPU, TPU, LPU, etc. The data may be used to process the information in a Neural Engine of a CPU. For improved processing power, a GPU-accelerated device may be used. Data may be processed in the cloud or on a specialized server that is placed on the rig site (e.g., an AI purpose designed server such as GPU server or platform).

In some embodiments, the system is used to detect potential issues while drilling. For example, stringers and/or other unexpected formation changes may be detected. In some embodiments, acoustic measurements of various areas of the rig site may be included in the data set. The acoustic signals may provide feedback for the work (e.g., from watt, current and/or torque data) being done on the formation by the rig relative to the power usage. Additionally, the time lag between the power levels and the acoustic signals may provide an early warning of events such as hole collapse, high torque scenarios, bottom hole assembly (BHA) vibration, bit wear, and/or other events. These signals may be used to help indicate the health of the rig, for example, when considering data from different wells.

In some embodiments, power, amperage, and/or voltage readings may be used classify the material being drilled through. For example, formation marking may be implemented. When the drill bit goes from one formation to another, a change in electricity may be observed, which may be compared to a modeled system to determine that the change in formation has occurred. For example, there may be an established baseline, and a variation may be recognized to detect variation from the baseline to determine formation tops (e.g., a transition from one type of formation to another). Stringers (e.g., thin layers of rock or mineral which may be hard formation inserts 2-3 feet in width or length) can be detected and/or mapped.

The AI (e.g., machine learning model) may be trained using a dataset with parameters related to each other. The training may be supervised or unsupervised. The unsupervised training may involve feeding data to a k-means algorithm and let the algorithm find subsets of data. In some embodiments, the data may be tabularized for deep neural networks. In some embodiments, the data may enable the trained model to estimate wear and tear on the bit. Generative AI technology may be used for data interpretation (e.g., generating human readable text from data). Generative AI technology may be used to generate a formation image (e.g., generate an image of a formation, formation tops, changes, etc. from data). Generative AI may be used to generate a formation properties image (e.g., generate formation information such as porosity, permeability, geomechanical strength of formation, etc. from data). Generative AI may be used to improve the resolution of seismic logs (e.g., generate super-resolution seismic images from data). Other generative AI applications may also be applied.

The trained machine learning model may be able to receive data indicating a power consumption increase, and based on that increase, infer that the drill bit has transitioned from a formation of medium hardness to a formation of high hardness. The model may adjust for the gradual increase in energy required to drill as the drill bit goes deeper even in the absence of a hardness change.

In some embodiments, the neural network may determine a threshold at which a change in formation is detected. If a harder formation is detected, drilling parameters may be adjusted to compensate. For example, after drilling through a soft formation, the drill bit may enter a hard formation. Upon detecting the harder formation, the machine learning model may output a recommendation or a signal to ease off (e.g., reduce rotational speed and/or weight on bit). Potential events may be detected, and then a correction may be made to protect the downhole equipment. In some embodiments, the machine learning model outputs a signal or a recommendation to stop drilling in response to detecting a stringer. In some embodiments, drilling is stopped automatically, which may prevent damage to the drill bit.

A change in one or more drilling parameters may be performed in response to detecting something in the formation. The change in drilling parameter could include, for example, starting, stopping, slowing down, increasing weight on string, changing fluid flow, or any other suitable change. The response time may be within a few seconds of information being receive by the machine learning model. In some embodiments, the information is streamed in real time or in nearly real time. In fully automated rigs, responses may be executed automatically, for example, less than a minute after a change in one or more parameters is detected. In some embodiments, humans are presented the option to intervene before, during, or after the automatic change. Alternatively, the system may present a suggestion to humans based on a result of analyzing the incoming parameters.

The parameters may include thermal parameters. When drilling fluid heats up, it becomes less viscous than when it is cold. This information may be used to initiate a start of drilling (e.g., when it is detected that the fluid is at the right temperature). Alternatively, rheology or viscosity may be monitored to determine when to start drilling. In some embodiments, different rheology, viscosity and/or temperature may be required depending on the hardness of the formation.

In some embodiments, a decision can be made by the AI system about how to steer the drill. For example, the system may control how hard a turn is taken depending on energy consumption. In some embodiments, acoustics can be taken into account. For example, sensors can detect an acoustic signal from the drilling site, which can be sent to the AI model for analysis. The AI model can recognize what is happening at the drill site based on the acoustic input. For example, based on an acoustic signature, the AI model may recognize that a transition has occurred from drilling one formation to drilling another formation. Voltage, amperage, and/or current signatures may be analyzed together with the acoustic signal.

Referring to FIG. 1, an exemplary wellbore drilling environment 50 is shown. The system and method for monitoring a drilling operation can be implemented in the wellbore drilling environment 50. In some embodiments, the wellbore 6 can be drilled into the subterranean formation 4 using any suitable drilling technique and can extend in a substantially vertical direction away from the earth's surface 2. At some point in the wellbore 6, the vertical wellbore portion can transition into a substantially horizontal wellbore portion. The drilling system can include a drill bit 8 and a bottom hole assembly 10 mechanically coupled to a tubular (e.g., drill string 12). The drill string 12 generally comprises an inner bore for the transfer of drilling fluids to the drill bit 8. The drilling fluids, e.g., drilling mud, can cool and lubricate the drill bit 8 and lift drill cuttings to the surface along the annulus 14 between the drill string 12 and wellbore 6. In some contexts, the drill string 12 can be referred to as a drill string.

The system for monitoring the drilling operation may comprise the drilling system or one or more elements of the drilling system. The drilling system can comprise a drilling rig 20, which may include a lifting mechanism, a fluid system, and a rotation mechanism. The lifting mechanism may be a block and tackle system including a crown block 22 and a traveling block 24 releasably connected to the drill string 12. The crown block 22 may stay stationary while the traveling block 24 raises and lowers the drill string 12 and downhole assembly, e.g., drill bit. A draw-works 40 can provide the mechanical force, via a drill line, to raise and lower the traveling block 24. The lifting mechanism can control the amount of weight applied to the bottom hole assembly (BHA) 10 and drill bit 8. The lifting mechanism may include sensors such as block height sensor, block speed sensor, hook load sensor, and weight indicator. The system for monitoring the drilling operation can include one or more of these sensors.

The drilling system can comprise a fluid system to transport drill cuttings to surface. The fluid system can provide the drilling fluid flowrate and pressure down the inner bore of the drill string 12 to the drill bit 8. The fluid system can comprise a return line 28B, a shale shaker 34, a mud tank 36, a suction line, a mud pump 38, a stand pipe 28A, and a swivel 26. The fluid system may provide a fluid circuit to transport drill cuttings to surface, separate the cuttings, and circulate clean drilling mud back to the drill bit 8. The mud tank 36 may provide the mud pump 38 a volume of drilling fluid to circulate down the drill string 12 via the stand pipe 28A and swivel 26. The drilling fluid, e.g., drilling mud, may cool and lubricate the drill bit 8 while transporting the drill cuttings back to surface via the annulus 14. The shale shaker 34 may receive the drilling fluid, via the return line 28B, separate the drill cuttings from the drilling mud, and return the drilling mud to the mud tank 36 to cool. The fluid system may include a wellhead, blowout preventer, and bell nipple for pressure control of the wellbore environment. The fluid system may include sensors such as flowrate sensors, pressure sensors, and tank volume sensors.

The drilling rig 20 can comprise a rotation mechanism for rotating the drill string 12. The rotation mechanism can provide the rotational speed of the drill bit 8 and drill string 12. The rotational mechanism for the drilling rig 20 can include a kelly 32, a kelly bushing, and a rotary table. The rotary table can mechanically couple the kelly 32 with the kelly bushing to the rig structure to provide rotation to the drill string 12. The rotation of the rotary table may provide rotation to the drill string 12 via the kelly 32. The rotational motion mechanism of the drilling rig 20 can include a top drive device to provide mechanical rotation of the drill string 12. The rotation mechanism can include sensors such as a torque sensor and a rotary speed sensor. The system for monitoring the drilling operation can include one or more of these sensors.

The wellbore drilling environment 50 may include surface equipment for the control and monitoring of the drilling process. The drilling system can include a unit controller 42 comprising a processor, a non-transitory memory, and a communication device 46. The unit controller 42 can be communicatively connected to the drilling system via wired cable 44 or a wireless communication method, e.g., WIFI. The unit controller 42 can direct the drilling via drilling personnel, e.g., the driller, or may automate a portion of the drilling process via wired or wireless communication. Sensors for the lifting mechanism, the fluid system, the rotation mechanism, and the wellhead can provide feedback to the unit controller 42 via a data acquisition (DAQ) unit. The communication device 46 can communicatively connect the unit controller 42 to one or more remote user devices. The data gathered by the sensors can include stress, strain, flow rate, pressure, temperature, and/or acoustic data. The system for monitoring the drilling operation can include one or more sensors to gather this data.

Although the wellbore drilling environment 50 is illustrated as a wellsite on land, it is understood that the wellbore drilling environment 50 can be offshore. The wellhead can be mechanically coupled to surface casing to anchor the wellhead and blowout preventer at the surface 2. The wellhead can include any type of pressure containment equipment connected to the top of a casing string, such as a surface tree, production tree, subsea tree, lubricator connector, blowout preventer, or combinations thereof. The wellhead can be located on a production platform, a subsea location, a floating platform, or other structure that supports operations in the wellbore 6. In some cases, such as in an off-shore location, the wellhead may be located on the sea floor while the drilling rig 20 can be located on a structure supported by piers extending downwards to a seabed or supported by columns sitting on hulls and/or pontoons that are ballasted below the water surface, which can be referred to as a semi-submersible platform or floating rig.

Figure 2:
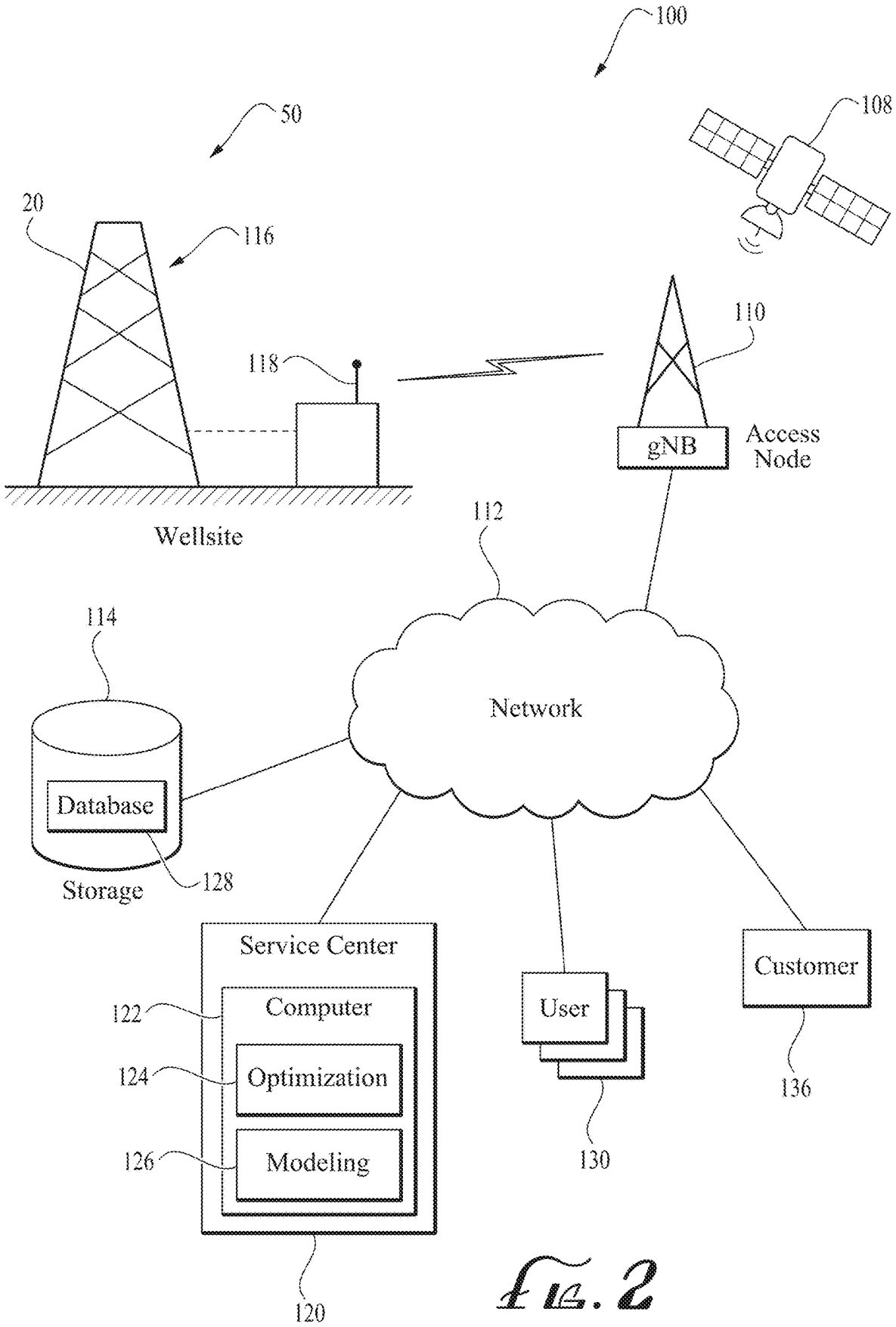
FIG. 2 is a schematic diagram of a communication system, according to an embodiment.

Referring to FIG. 2, a communication system 100 is described. The system for monitoring the drilling operation may include the communication system 100 or one or more elements of the communication system 100. The communication system 100 may allow the implementation of the system and method for monitoring the drilling operation. The communication system 100 may include a cellular site 110, a network 112, a storage computer 114, a computer system 122, user devices 130, and/or a customer device 136. A wellsite 116 with a communication device 118 (e.g., communication device 46 of FIG. 1) can transmit via any suitable communication means (wired or wireless), for example wirelessly connect to a cellular site 110 to transmit data to a storage computer 114. The cellular site 110 can be communicatively connected to a network 112 that can include a 5G network, one or more public networks, one or more private networks, or a combination thereof. The storage computer 114 can be communicatively connected to the network 112. The service center 120 can have one or more servers and/or computer systems 122. A drilling optimization application 124 (e.g., configured to perform the method of monitoring a drilling operation) can be executing on a computer system 122 in the service center 120.

A communication device 118 on a wellsite 116 can transmit data collected from the equipment sensors, wellhead sensors, and/or BHA to the storage computer 114. The communication device 118 can comprise a storage device and a data transmission device. The communication device 118 can wirelessly connect to the cellular site 110 continuously or at a predetermined schedule. In some embodiments, the communication device 118 can connect or attempt connection to the storage computer 114 via the cellular site 110 based on an established schedule. In some embodiments, the drilling optimization application 124 can request the data from the communication device 118 based on an established schedule. The storage computer 114 can connect or attempt connection to the communication device 118 via cellular site 110 based on an established schedule. The communication device 118 can wirelessly connect to the network 112 via satellite communication 108.

The storage computer 114 can include a historical database 128 of datasets from remote drilling operations. A wellsite 116 can transmit one or more datasets indicative of a drilling operation. For example, the historical database 128 may comprise a datasets from wellbore drilling operations at one or more wellsites, e.g., 116. The datasets within the historical database 128 may comprise one or more wellsites 116 within the same drilling environment 50.

A user device 130 can transfer a dataset from the storage computer 114 to a drilling optimization application 124 executing on a computer system 122 in the service center 120. The dataset can include the data collected from wellsite 116 over a designated time period. The dataset can include a dataset from a complete drilling operation. Alternatively, a dataset from the storage computer 114 can be transferred automatically or via a scheduler to a drilling optimization application 124. The drilling optimization application 124 can determine a drilling procedure for a wellsite 116. The user device 130 can receive customer inputs from a customer device 136. The user device 130 can transmit the customer inputs and at least one dataset from the historical database 128 to the analysis process via the drilling optimization application 124. The drilling optimization application 124 can compare a generic drilling procedure to the dataset from the historical database 128 to generate a recommended drilling procedure.

The wellsite 116 may transmit datasets indicative of a current drilling operation to the drilling optimization application 124. The drilling optimization application 124 may run the machine learning model 126 and may recommend change to the drilling procedure based on one or more periodic or real time datasets received from the wellsite 116 via the communication device 118. In more detail, the service center 120 may receive one or more parameters of a drilling operation of a drilling rig 20 from sensors. One or more processors of the service center 120 may recognize, using a trained machine learning model 126, a signature in the one or more parameters; determine a corrective action (e.g, using an optimization algorithm 124) based on the recognized signature; and output a recommendation for performing the corrective action or autonomously executing the corrective action (e.g., to the communication device 118 via the network 112). The recommendation or autonomously executed corrective action may be implemented at the wellsite 116.

The one or more parameters may include well trajectory (e.g., inclination), wellbore environment conditions (e.g., temperature and/or pressure, drilling parameters (e.g., torque, weight on bit, RPM), formation data (e.g., lithology), and/or mud data (e.g., mud weights, rheology). In some embodiments, the parameters can include drilling parameter values for the mud system including pump pressure, circulation pressure, flow rate, density, or combinations thereof. In some embodiments, the parameters can include wellbore trajectory values for inclination, buildup rate, sliding, or combinations thereof. The drilling parameters can include average ROP, average inclination and buildup rate, rotary and sliding percentage, drilling bit total energy, KREV, differential pressure, RPM, WOB, ROP limiters, and ROP control state. The ROP limiters can indicate a system in the drilling operation that limits the maximum ROP. The ROP limiters can include auto-driller system status, maximum limit value of torque, maximum limit value of pump pressure, maximum limit of differential pressure, maximum limit value of WOB, maximum limit value of ROP, or combinations thereof. For example, the drilling operation may experience a low value of WOB during the drilling operation in a shallow area, e.g., close to surface.

Figure 3:
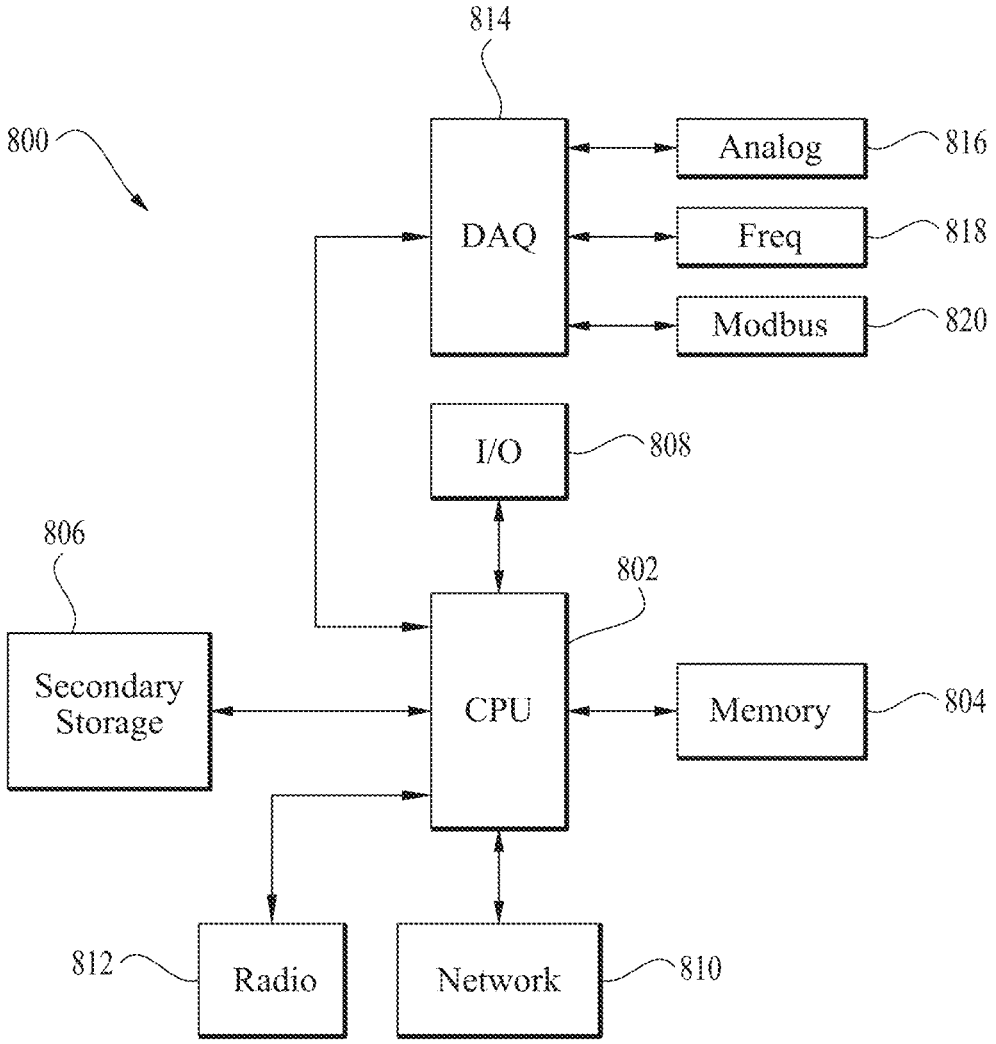
FIG. 3 is a schematic diagram of a computer system, according to an embodiment.

Referring to FIG. 3, the system for monitoring the drilling operation may include a computer system 800 or one or more elements of the computer system 800. The computer system 800 may implement the system and method of the present disclosure and may include one or more processors 802 (which may be referred to as a processor, central processor unit, or CPU) that is in communication with memory 804, secondary storage 806, input output devices 808, DAQ card 814, and network devices 810. The computer system 800 may continuously monitor the state of the input devices and change the state of the output devices based on a programmed instructions. The programmed instructions may comprise one or more applications retrieved from memory 804 for executing by the processor 802 in non-transitory memory (e.g., within memory 804). The input output devices may comprise a human-machine interface with a display screen and the ability to receive inputs from service personnel such as push button, touch screen, keyboard, mouse, or any other device or element that a service personnel may utilize to input a command to the computer system 800. The secondary storage 806 may comprise a solid-state memory, a hard drive, or any other type of memory suitable for data storage. The secondary storage 806 may comprise removable memory storage devices such as solid-state memory or removable memory media such as magnetic media and optical media, i.e., CD disks. The computer system 800 can communicate with various networks with the network devices 810 comprising wired networks, e.g., Ethernet or fiber optic communication, and short-range wireless networks such as Wi-Fi (i.e., IEEE 802.11), Bluetooth, or other low power wireless signals such as ZigBee, Z-Wave, 6LoWPan, Thread, and WiFi-ah. The computer system 800 may include a long-range radio transceiver 812 for communicating with mobile network providers.

The computer system 800 may comprise a DAQ card 814 for communication with one or more sensors. The DAQ card 814 may be a standalone system with a microprocessor, memory, and one or more applications executing in memory. The DAQ card 814, as illustrated, may be a card or a device within the computer system 800. In some embodiments, the DAQ card 814 may be combined with the input output device 808. The DAQ card 814 may receive one or more analog inputs 816, one or more frequency inputs 818, and one or more Modbus inputs 820. The DAQ card 814 may convert the signals received via the analog input 816, the frequency input 818, and the Modbus input 820 into the corresponding sensor data.

The drilling rig may have rotary encoder for the shaft, also referred to as a shaft encoder, which may provide data on the angular motion of the drive shaft including position, speed, distance, or any combination thereof. The rotary encoder may be an absolute rotary encoder, an incremental encoder, or any electro-mechanical device that converts angular position or motion to analog and/or digital signals.

The drilling rig may receive feedback or determine feedback from one or more dependent parameters, for example motor speed. The one or more processors may determine motor speed, output current, output torque, power factor, load percentage, total power output, pumping operation parameters, or combinations thereof. For example, the one or more processors may determine motor speed, typically given in RPM, as a function of the output frequency and one or more other characteristics, for example, number of poles within the motor. The one or more processors can determine the output current, e.g., current delivered to the motor, in response to the power load, the output voltage, and output frequency. The one or more processors can determine the output torque as a function of the output power and the motor speed. An exemplary expression for the output torque is expressed in Equation 1:

$$T = \frac{P \times 60}{2\pi \times N} \quad \text{(Equation 1)}$$

where T is the torque in Newton meters (Nm), P is the power in watts (W), and N is the speed in RPM. An exemplary expression for the power (P) is expressed in Equation 2:

$$P = \sqrt{3} \times V \times I \times PF \times \mu \quad \text{(Equation 2)}$$

where: V is the root mean square (RMS) voltage, I is the RMS current (amperes), PF is the power factor (dimensionless) and u is the motor efficiency (dimensionless). The power factor can be a measure of how effectively the power, e.g., voltage and current, is being utilized and can be determined from the voltage and current waveforms. The load percentage can be determined by comparing a current load to an operational limit. The total power output can be the total power delivered and can be derived from the voltage, current, and power factor. Although six dependent variables for the VFD have been described, it is understood that the VFD may have more dependent variables, for example, energy consumption, drive status, alarm codes, DC bus voltage, braking resistor status, input phase balance, PID feedback, and/or any other variable.

Figure 6:
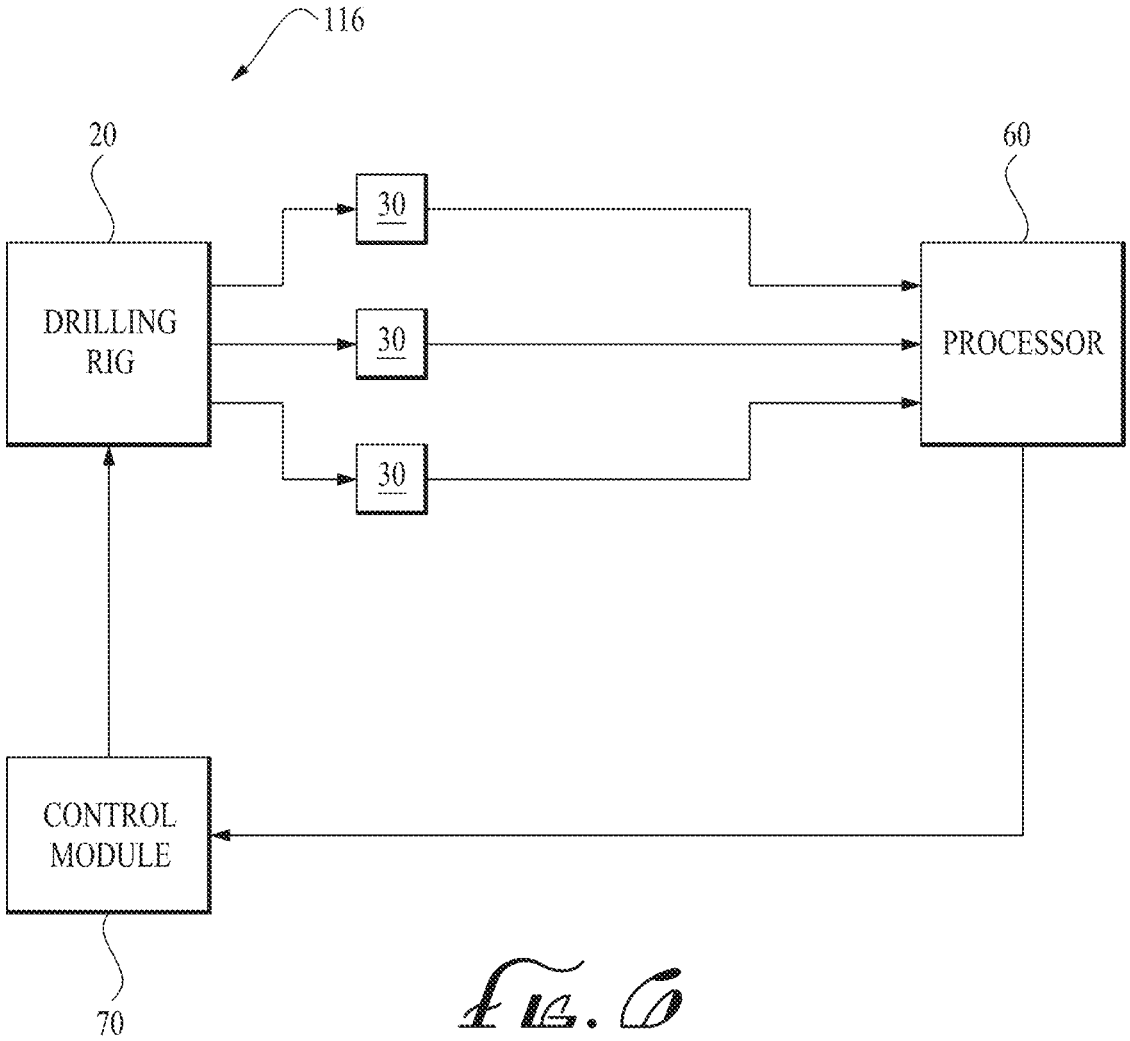
FIG. 6 is a schematic diagram of a wellsite having a monitored drilling rig, according to an embodiment.

Referring to FIG. 6, a drilling operation of a drilling rig 20 may be monitored. The system for monitoring the operation of the drilling rig may include one or more of the elements shown in FIG. 6. A processor 60 (e.g., one or more processors such as the one or more processors 802 shown in FIG. 3) that runs the machine learning model may receive one or more parameters of a drilling operation of the drilling rig 20. The parameters may be detected by sensors 30 (e.g., one or more sensors). The one or more parameters may be transmitted (e.g., streamed in real time) from the sensors 30 to the processor 60. The processor 60 may recognize, using the trained machine-learning model, a signature in the one or more parameters, determine a corrective action based on the recognized signature, and output a recommendation for performing the corrective action to a control module 70 or autonomously execute the corrective action using the control module 70. The control module 70 may comprise a display where the recommendation is displayed for an operator to see. The operator may make a decision on how to control the drilling rig 20 based on the recommendation. Alternatively, the control module 70 may, in response to receiving a signal from the processor 60, autonomously execute the corrective action by sending control signals to the drilling rig 20 to control the drilling rig 20 in accordance with the signal from the processor 60. In some embodiments, the control module 70 is or includes the controller 42 shown in FIG. 1.

The one or more parameters may comprise wattage of electric power consumed by a motor of the drilling rig 20, voltage of the electric power, amperage of the electric power, or any combination thereof. The one or more parameters may comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof. The drilling rig may comprise a motor, a top drive mechanically coupled to the motor, a drill string mechanically coupled to the top drive, and a drill bit mechanically coupled to the drill string. Any of these components may be part of the system for monitoring the operation of the drilling operation. The sensors 30 may comprise a volt meter, and an ohm meter, a force gauge, a torque gauge, a thermometer, a microphone, or any combination thereof. Any of these sensors may be part of the system for monitoring the operation of the drilling operation.

The trained machine-learning model may be a trained neural network. The machine-learning model may be run on a neural engine, a tensor processing unit, a neural tensor unit, or a logical tensor unit. The machine-learning model may be trained by supervised learning from historical data. The signature may be recognized by matching the received parameters with an event from the historical data. The machine-learning model may be trained by unsupervised learning from historical data. The signature may be recognized by matching the one or more parameters as an anomaly in comparison with the historical data.

The recommendation may be a recommendation to alter pump rate in the drilling operation of the drilling rig 20, revolutions per minute in the drilling operation, weight on bit in the drilling operation, drilling fluid properties in the drilling operation, rate of penetration in the drilling operation, or combinations thereof. The recommendation may be displayed on the display of the control module 70. The autonomous execution the corrective action may include altering an operation of the drilling rig 20 via the control module 70. The autonomous execution of the corrective action may include altering pump rate in the drilling operation of the drilling rig 20, revolutions per minute in the drilling operation, weight on bit in the drilling operation, drilling fluid properties in the drilling operation, rate of penetration in the drilling operation, or any combination thereof. Executing the corrective action may include initiating the corrective action or scheduling initiation of the corrective action, displaying an indication of the corrective action on a display of the control module 70, and/or displaying a button for cancelling the corrective action on the display of the control module 70.

Based on signatures recognized using the trained machine-learning model, alerts based on actual or predicted drilling events may be output. These alerts may be designed to minimize risks, lower non-productive time, maximize asset value and/or increase overall system performance. In tandem with such alerts, the processor 60 may unilaterally or upon command execute one or more actions to control the drilling operation of the drilling rig 20. For example, if the processor 60 use real-time drilling operations measurements to determine that the rate of penetration is excessive, it may communicate with equipment at the wellsite 116 site via the control module 70 to lower the rate of penetration.

The processor 60 running the machine learning model may be provided with information about the drilling environment and may also be communicably coupled to one or more computers or other equipment (e.g., the control module 70) that control various aspects of the drilling environment. For example, the processor 60 may communicate with a computer at the drilling site, which, in turn, controls and/or monitors some or all drilling operations. The processor 60 may have one or more contact points at the drilling site (e.g., sensors 30) for obtaining real-time information about the drilling site and to control equipment at the drilling site (e.g., via the control module 70). In general, "real-time information" is information that is collected and relayed to the processor 60 virtually immediately. Although the precise meaning of "real time" may vary based on the specific data collection in question, the term generally connotes a span of time on the order of milliseconds or seconds. For example, "real-time information" is information that, after having been collected by the sensors 30, is relayed to the processor 60 within a span of five seconds.

The processor 60 may monitor drilling operations as they begin and progress. For example, the processor 60 may monitor real-time drilling operations measurements, such as rate of drill bit penetration, drill bit revolutions per minute, weight on bit, and fluid pump rate. If the processor 60 determines that any of these or other drilling operations measurements indicate a possible problem—for instance, a safety concern—the processor 60 may generate a drilling operations alert that is provided to a human user or to another computer, such as another cognitive computer. The processor 60 may provide additional information with the drilling operations alert, such as suggestions regarding how to address the alert. In determining whether an alert should be output, the processor 60 may run a simulation to predict an outcome if no action is taken. The processor 60 may also run a simulation to predict an outcome if a corrective action is taken. The processor 60 may determine whether to generate the alert and/or automatically intervene based on either one or both of these simulations.

In addition to monitoring real-time drilling operations, the processor 60 may use drilling operations measurements (i.e., data collected from the sensors 30) to identify issues that might be presently occurring and/or predict issues that may arise in the future. In particular, the processor 60 may use the drilling operations measurements in tandem with one or more types of simulations to obtain additional information about the drilling environment. These simulations may reveal information about the drilling environment that can be useful to identify potential drilling operations alerts—for instance, relating to personnel safety, environmental safety, operational efficiency, and the like. The processor 60 may select specific simulations for use based on its training and learning from similar situations in the past.

The sensors 30, which may send data to the processor 60, may include information collection devices that may be used at the wellsite 116. For example, the sensors 30 may include transducers that measure some physical property in the drilling operation, such as pressure sensors, density sensors, etc. The sensors 30 are not limited to devices that measure quantifiable parameters; they may include subjective, non-quantifiable information such as video and audio, which, in turn, can be interpreted by a trained model run on the processor 60.

The processor 60 running the model may act as a controller and/or be in communication with a control module 70 that controls specific drilling equipment of the drilling rig 20 that performs particular functions (e.g., equipment to increase or decrease the weight on bit, to steer or rotate drilling, to stop and start drilling, to collect various measurements using the sensors 30, etc.). The control module 70 may control any drilling equipment associated with the drilling rig 20. Alternatively, an operator may control the drilling rig 20 in response to a recommendation or drilling operations alert generated by the processor 60 (e.g., displayed on a display of the control module 70).

The alert may be sent via any type of media. For example, the alert may be an audio alert, visual alert, audiovisual alert, and/or a tactile alert (e.g., vibration). In addition, the alert may be delivered by the processor 60 via a display or through a device (e.g., a mobile phone) controlled by or in communication with the processor 60. The alerts may be sent through a network. The network may be the Internet or an intranet and, more generally, may be any type of network through which the processor 60 may send and/or receive information to or from another electronic device. In some embodiments, the processor 60 provides drilling operations alerts to other devices via the network.

The processor 60 may analyze the real-time and/or historical drilling operations measurements and drilling operations simulation results. In performing this analysis, the processor 60 may determine which drilling operations events are occurring and which drilling operations events are likely to occur. For example, the processor 60 may look for potential warning signs such as unexpected influx, torque and drag issues, excessive cuttings build up, excessive drill string vibration, bit balling, lost circulation, wellbore pressure measurements exceeding prescribed parameters, equivalent circulating density, and the like. The processor 60 may determine which drilling operations parameters may be adjusted to result in enhanced (e.g., more efficient) drilling operations.

Figure 5:
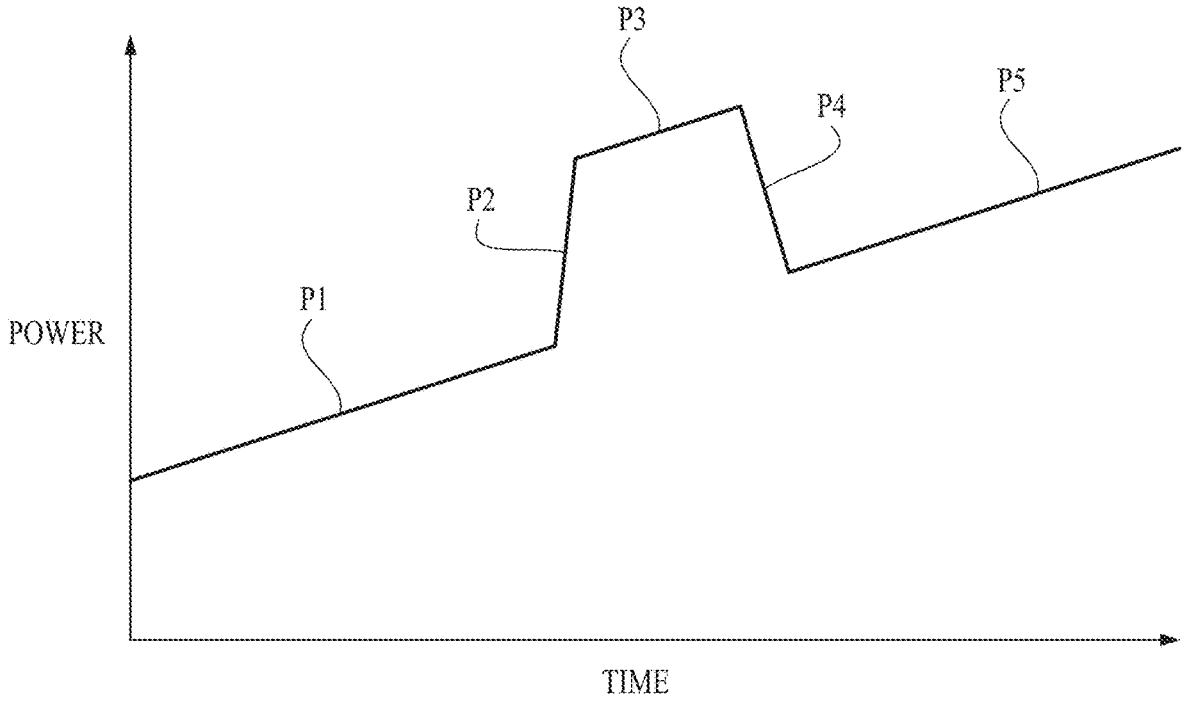
FIG. 5 is a graph of power over time of a drilling rig, according to an embodiment.

Referring to FIG. 5, sensors may monitor a power consumption of the drilling rig over time. During a first phase P1, power consumption may gradually increase due to the drill bit penetrating deeper into a first formation. During a second phase P2, power consumption may sharply rise. The processor, which may be continuously monitoring the power consumption, may use the trained model to determine, based on the sharp increase, that the drill bit has transitioned from the first formation to a second formation that is harder than the first formation. That is, the second formation may be of a type that is harder than a type of the first formation. The processor may make an adjustment based on this, for example, to reduce rotational speed, which may help preserve the life of the drill bit. During the third phase P3, the drill bit may continue to penetrate the second formation, and thus the power consumption may gradually increase. During the fourth phase P4, the power consumption may sharply fall. The processor may determine, based on the sharp decrease, that the drill bit has transitioned from the second formation to a third formation. The processor may determine, based on data regarding the depth and the previous formations drilled through, that the third formation is the same type as the first formation. That is, the third formation may have the same hardness as the first formation. During the fifth phase P5, power consumption may continue to gradually increase as the drill bit penetrates farther into the third formation. The detection of the change information may be based on a comparison of the input power to rate of work being done by the drill bit. The input power may be the wattage consumed by the drilling rig for the drilling operation (e.g., wattage consumed by a motor driving a drill bit). The rate of work being done by the drill bit may be based on torque exerted on the drill bit, rate of penetration, and/or other parameters indicative of work being done by the drill bit on the formation.

Figure 4:
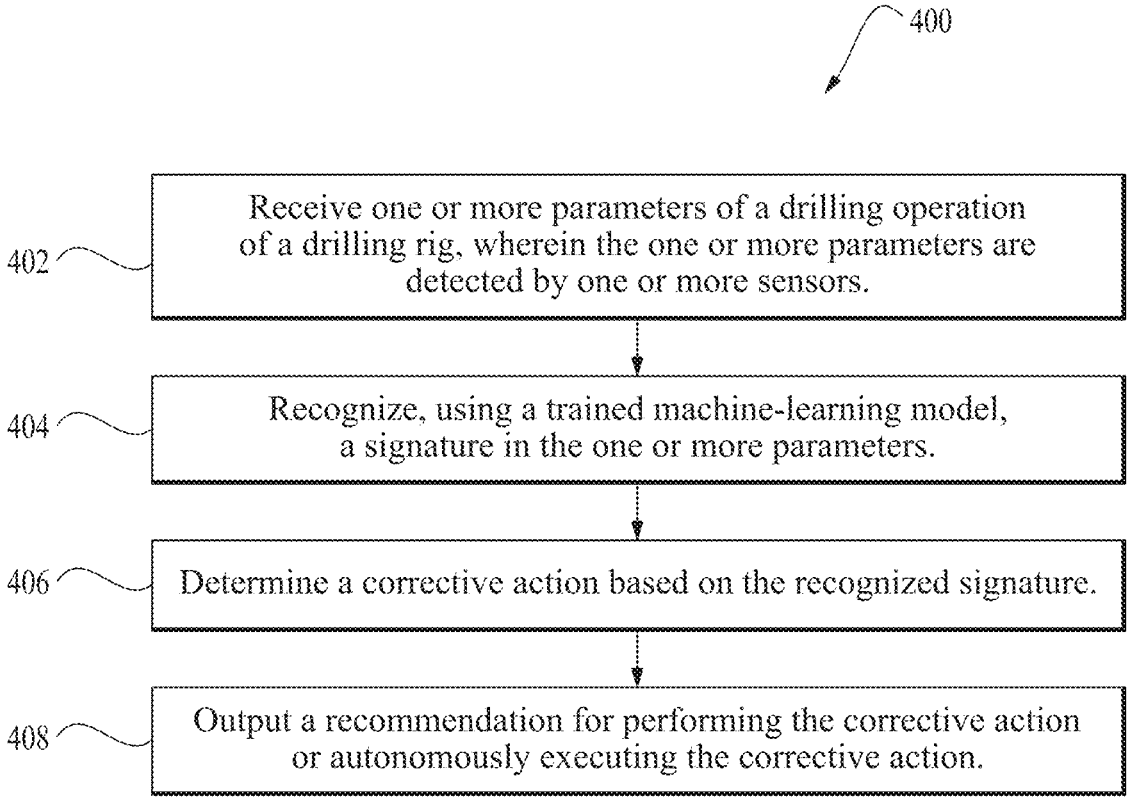
FIG. 4 is a flow diagram of a method of monitoring a drilling operation of a drilling rig, according to an embodiment.

Referring to FIG. 4, a method 400 of monitoring a drilling operation of a drilling rig may include the step 402 of receiving one or more parameters of a drilling operation of a drilling rig, wherein the one or more parameters are detected by one or more sensors; the step 404 of recognizing, using a trained machine-learning model, a signature in the one or more parameters; the step 406 of determining a corrective action based on the recognized signature; and the step 408 of outputting a recommendation for performing the corrective action or autonomously executing the corrective action.

The one or more parameters may be streamed in real time to a processor that runs the machine learning model. The one or more parameters may comprise wattage of electric power consumed by a motor of the drilling rig, voltage of the electric power, amperage of the electric power, or any combination thereof. The one or more parameters may comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof. The drilling rig may have a motor, a top drive mechanically coupled to the motor, a drill string mechanically coupled to the top drive, and a drill bit mechanically coupled to the drill string. The one or more sensors may comprise a volt meter, and an ohm meter, a force gauge, a torque gauge, a thermometer, a microphone, or any combination thereof.

The trained machine-learning model may be a trained neural network. The machine-learning model may be run on a neural engine, a tensor processing unit, a neural tensor unit, or a logical tensor unit. The machine-learning model may be trained by supervised learning from historical data, and wherein the recognizing of the signature comprises matching the received parameters with an event from the historical data. The machine-learning model may be trained by unsupervised learning from historical data. The recognizing of the signature may include recognizing the one or more parameters as an anomaly in comparison with the historical data.

The method 400 may further comprise outputting a recommendation to alter pump rate in the drilling operation, revolutions per minute in the drilling operation, weight on bit in the drilling operation, drilling fluid properties in the drilling operation, rate of penetration in the drilling operation, or combinations thereof. The method 400 may further comprise displaying the recommendation on a display. The method may further comprise altering an operation of a drilling rig. The method 400 may further comprise altering pump rate in the drilling operation, revolutions per minute in the drilling operation, weight on bit in the drilling operation, drilling fluid properties in the drilling operation, rate of penetration in the drilling operation, or any combination thereof. The method 400 may further comprise initiating the corrective action or scheduling initiation of the corrective action, displaying an indication of the corrective action on a display, and/or displaying a button for cancelling the corrective action. There may be a non-transitory computer-readable medium storing instructions that, when executed by a processor, cause the processor to execute the method 400.

The system and method of the present disclosure may enable higher granularity, accuracy, and/or precision of detecting occurrences in a wellbore environment based on changing parameters and/or changes in drilling operation. It may allow for an improved operational timeline. Furthermore, it may improve overall readability of occurrences in the wellbore environment, which may be independent from human observations and/or may confirm human observations. Parameter changes may be analyzed by the machine learning model for improved mapping of the formation. The system and method of the present disclosure may reduce risk of misalignment of landing the drill string in the payzone. Overall improvements in the well timeline operations may be achieved by the system and method of the present disclosure. The system and method of the present disclosure may present the advantages of reducing workload on humans, improving operational readiness, and/or enabling semi-autonomous or fully autonomous drilling.

ADDITIONAL DISCLOSURE

The following are non-limiting, specific embodiments in accordance with the present disclosure:

In a first embodiment, a processor-implemented method of monitoring a drilling operation of a drilling rig comprises receiving one or more parameters of a drilling operation of a drilling rig, wherein the one or more parameters are detected by one or more sensors; recognizing, using a trained machine-learning model, a signature in the one or more parameters; determining a corrective action based on the recognized signature; and outputting a recommendation for performing the corrective action or autonomously executing the corrective action.

A second embodiment can include the method of the first embodiment, wherein the one or more parameters are streamed in real time to one or more processors, which run the machine learning model.

A third embodiment can include the method of the first or second embodiments, wherein the one or more parameters comprise wattage of electric power consumed by a motor of the drilling rig, voltage of the electric power, amperage of the electric power, or any combination thereof.

A fourth embodiment can include the method of any of the first through third embodiments, wherein the one or more parameters comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof.

A fifth embodiment can include the method of any of the first through fourth embodiments, wherein the drilling rig comprises a motor, a top drive mechanically coupled to the motor, a drill string mechanically coupled to the top drive, and a drill bit mechanically coupled to the drill string.

A sixth embodiment can include the method of any of the first through fifth embodiments, wherein the one or more sensors comprise a volt meter, and an ohm meter, a force gauge, a torque gauge, a thermometer, a microphone, or any combination thereof.

A seventh embodiment can include the method of any of the first through sixth embodiments, wherein the trained machine-learning model is a trained neural network.

An eighth embodiment can include the method of any of the first through seventh embodiments, wherein the machine-learning model is run on a neural engine, a tensor processing unit, a neural tensor unit, or a logical tensor unit.

A ninth embodiment can include the method of any of the first through eighth embodiments, wherein the machine-learning model is trained by supervised learning from historical data, and wherein the recognizing of the signature comprises matching the received parameters with an event from the historical data.

A tenth embodiment can include the method of any of the first through ninth embodiments, wherein the machine-learning model is trained by unsupervised learning from historical data, and wherein the recognizing of the signature comprises recognizing the one or more parameters as an anomaly in comparison with the historical data.

An eleventh embodiment can include the method of any of the first through tenth embodiments, wherein the method comprises the outputting of the recommendation, which comprises a recommendation to alter pump rate in the drilling operation, revolutions per minute in the drilling operation, weight on bit in the drilling operation, drilling fluid properties in the drilling operation, rate of penetration in the drilling operation, or combinations thereof.

A twelfth embodiment can include the method of any of the first through eleventh embodiments, wherein the method comprises the outputting of the recommendation, which comprises displaying the recommendation on a display.

A thirteenth embodiment can include the method of any of the first through twelfth embodiments, wherein the method comprises autonomously executing the corrective action, which comprises altering an operation of a drilling rig.

A fourteenth embodiment can include the method of any of the first through thirteenth embodiments, wherein the method comprises the autonomously executing of the corrective action, which comprises altering pump rate in the drilling operation, revolutions per minute in the drilling operation, weight on bit in the drilling operation, drilling fluid properties in the drilling operation, rate of penetration in the drilling operation, or any combination thereof.

A fifteenth embodiment can include the method of any of the first through fourteenth embodiments, wherein the method comprises autonomously executing the corrective action, which comprises initiating the corrective action or scheduling initiation of the corrective action, displaying an indication of the corrective action on a display, and/or displaying a button for cancelling the corrective action.

A sixteenth embodiment can include a non-transitory computer-readable medium storing instructions that, when executed by a processor, cause the processor to execute the method of any of the first through fifteenth embodiments.

In a seventeenth embodiment, a system for monitoring a drilling operation of a drilling rig comprises one or more processors configured to: receive one or more parameters of a drilling operation of a drilling rig, wherein the one or more parameters are detected by one or more sensors; recognize, using a trained machine-learning model, a signature in the one or more parameters; determine a corrective action based on the recognized signature; and output a recommendation for performing the corrective action or autonomously executing the corrective action.

An eighteenth embodiment can include the system of the seventeenth embodiment, wherein the one or more parameters are streamed in real time to a processor that runs the machine learning model.

A nineteenth embodiment can include the system of the seventeenth or eighteenth embodiments, wherein the one or more parameters comprise wattage of electric power consumed by a motor of the drilling rig, voltage of the electric power, amperage of the electric power, or any combination thereof. The system may comprise one or more sensors configured to detect one or more of these parameters.

A twentieth embodiment can include the system of any of the seventeenth through nineteenth embodiments, wherein the one or more parameters comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof. The system may comprise one or more sensors configured to detect one or more of these parameters.

A twenty-first embodiment can include the system of any of the seventeenth through twentieth embodiments, wherein the drilling rig comprises a motor, a top drive mechanically coupled to the motor, a drill string mechanically coupled to the top drive, and a drill bit mechanically coupled to the drill string. The system may comprise the drilling rig or any combination of elements of the drilling rig such as the motor, the top drive, and/or the drill string.

A twenty-second embodiment can include the system of any of the seventeenth through twenty-first embodiments, wherein the system comprises the one or more sensors and/or wherein the one or more sensors comprise a volt meter, and an ohm meter, a force gauge, a torque gauge, a thermometer, a microphone, or any combination thereof.

A twenty-third embodiment can include the system of any of the seventeenth through twenty-second embodiments, wherein the trained machine-learning model is a trained neural network. The system may comprise the trained neural network.

A twenty-fourth embodiment can include the system of any of the seventeenth through twenty-third embodiments, wherein the machine-learning model is run on a neural engine, a tensor processing unit, a neural tensor unit, or a logical tensor unit. The system may comprise a neural engine, a tensor processing unit, a neural tensor unit, or a logical tensor unit.

A twenty-fifth embodiment can include the system of any of the seventeenth through twenty-fourth embodiments, wherein the machine-learning model is trained by supervised learning from historical data, and wherein the recognizing of the signature comprises matching the received parameters with an event from the historical data.

A twenty-sixth embodiment can include the system of any of the seventeenth through twenty-fifth embodiments, wherein the machine-learning model is trained by unsupervised learning from historical data, and wherein the recognizing of the signature comprises recognizing the one or more parameters as an anomaly in comparison with the historical data.

A twenty-seventh embodiment can include the system of any of the seventeenth through twenty-sixth embodiments, wherein the outputting of the recommendation comprises a recommendation to alter pump rate in the drilling operation, revolutions per minute in the drilling operation, weight on bit in the drilling operation, drilling fluid properties in the drilling operation, rate of penetration in the drilling operation, or combinations thereof.

A twenty-eighth embodiment can include the system of any of the seventeenth through twenty-seventh embodiments, wherein the outputting of the recommendation comprises displaying the recommendation on a display. The system may comprise the display.

A twenty-ninth embodiment can include the system of any of the seventeenth through twenty-eighth embodiments, wherein the autonomously executing the corrective action comprises altering an operation of a drilling rig.

A thirtieth embodiment can include the system of any of the seventeenth through twenty-ninth embodiments, wherein the autonomously executing the corrective action comprises altering pump rate in the drilling operation, revolutions per minute in the drilling operation, weight on bit in the drilling operation, drilling fluid properties in the drilling operation, rate of penetration in the drilling operation, or any combination thereof.

A thirty-first embodiment can include the system of any of the seventeenth through thirtieth embodiments, wherein the one or more processors are configured to autonomously execute the corrective action, which comprises initiating the corrective action or scheduling initiation of the corrective action, displaying an indication of the corrective action on a display, and/or displaying a button for cancelling the corrective action.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A processor-implemented method of monitoring a drilling operation of a drilling rig, comprising:

receiving one or more parameters of a drilling operation of a drilling rig, wherein the one or more parameters are detected by one or more sensors;

recognizing, using a trained machine-learning model, a signature in the one or more parameters, wherein the recognizing of the signature comprises determining that a drill bit of the drilling rig has transitioned from a first formation to a second formation, based on a comparison of power consumption for the drilling operation to rate of work done by the drill bit, wherein the power consumption and the rate of work are obtained from the one or more parameters;

determining a corrective action based on the recognized signature; and autonomously executing the corrective action, wherein the corrective action comprises altering pump rate in the drilling operation, revolutions per minute in the drilling operation, weight on bit in the drilling operation, drilling fluid properties in the drilling operation, or rate of penetration in the drilling operation.

2. The method of claim 1, wherein the one or more parameters are streamed in real time to one or more processors, which run the machine learning model.

3. The method of claim 1, wherein the one or more parameters comprise wattage of electric power consumed by a motor of the drilling rig, voltage of the electric power, amperage of the electric power, or any combination thereof.

4. The method of claim 1, wherein the one or more parameters comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof.

5. The method of claim 1, wherein the drilling rig comprises a motor, a top drive mechanically coupled to the motor, a drill string mechanically coupled to the top drive, and a drill bit mechanically coupled to the drill string.

6. The method of claim 1, wherein the one or more sensors comprise a volt meter, an ohm meter, a force gauge, a torque gauge, a thermometer, a microphone, or any combination thereof.

7. The method of claim 1, wherein the trained machine-learning model is a trained neural network.

8. The method of claim 1, wherein the machine-learning model is run on a neural engine, a tensor processing unit, a neural tensor unit, or a logical tensor unit.

9. The method of claim 1, wherein the machine-learning model is trained by supervised learning from historical data, and wherein the recognizing of the signature further comprises matching the received one or more parameters with an event from the historical data.

10. The method of claim 1, wherein the machine-learning model is trained by unsupervised learning from historical data, and wherein the recognizing of the signature further comprises recognizing the one or more parameters as an anomaly in comparison with the historical data.

11. The method of claim 1, wherein the power consumption for the drilling operation comprises wattage of electric power consumed by a motor of the drilling rig.

12. The method of claim 1, further comprising displaying a button for cancelling the corrective action.

13. A non-transitory computer-readable medium storing instructions that, when executed by a processor, cause the processor to execute the method of claim 1.

14. A system for monitoring a drilling operation of a drilling rig, comprising:

one or more processors configured to:

receive one or more parameters of a drilling operation of a drilling rig, wherein the one or more parameters are detected by one or more sensors;

recognize, using a trained machine-learning model, a signature in the one or more parameters to determine that a drill bit of the drilling rig has transitioned from a first formation to a second formation, based on a comparison of power consumption for the drilling operation to rate of work done by the drill bit, wherein the power consumption and the rate of work are obtained from the one or more parameters;

determine a corrective action based on the recognized signature; and autonomously execute the corrective action, wherein the corrective action comprises altering pump rate in the drilling operation, revolutions per minute in the drilling operation, weight on bit in the drilling operation, drilling fluid properties in the drilling operation, or rate of penetration in the drilling operation.

15. The system of claim 14, wherein the one or more parameters comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof.

16. The system of claim 14, wherein the trained machine-learning model is a trained neural network.

17. The system of claim 14, wherein the one or more parameters comprise wattage of electric power consumed by a motor of the drilling rig, voltage of the electric power, amperage of the electric power, or any combination thereof.

18. The system of claim 14, wherein the one or more parameters comprise rate of drill bit penetration, drill bit revolutions per minute, weight on bit, fluid pump rate, fluid rheology, physical properties of fluid, standpipe pressure, pressure while drilling, temperature while drilling, pipe running speed, or any combination thereof.

19. The system of claim 14, wherein the drilling rig comprises a motor, a top drive mechanically coupled to the motor, a drill string mechanically coupled to the top drive, and a drill bit mechanically coupled to the drill string.

20. The system of claim 14, wherein the one or more sensors comprise a volt meter, an ohm meter, a force gauge, a torque gauge, a thermometer, a microphone, or any combination thereof.

* * * * *